US005992648A

United States Patent [19]

Saunders

[11] Patent Number: 5,992,648

[45] **Date of Patent: *Nov. 30, 1999**

[54] PRODUCT DISPLAY SYSTEM

[76] Inventor: Todd Robert Saunders, 15756 Margaret Ave., Spring Lake, Mich. 49456

[ * ] Notice: This patent is subject to a terminal disclaimer.

[21] Appl. No.: 09/169,783

[22] Filed: Oct. 9, 1998

Related U.S. Application Data

[63] Continuation-in-part of application No. 08/967,398, Nov. 11, 1997

[60] Provisional application No. 60/030,654, Nov. 12, 1996.

[51] Int. Cl.[6] ..... A47F 7/08; A47F 5/08

[52] U.S. Cl. ..... 211/35; 211/89.01

[58] Field of Search ..... 211/35, 89.01, 211/153

[56] References Cited

U.S. PATENT DOCUMENTS

| | | | |
|---|---|---|---|
| 1,949,017 | 2/1934 | Knupp | 211/35 |
| 2,205,817 | 6/1940 | Kramb | 211/35 X |
| 2,286,539 | 6/1942 | Hagerstrom | 211/35 X |
| 2,412,847 | 12/1946 | Tilburg | 211/35 |
| 2,457,445 | 12/1948 | Clair | 211/35 X |
| 2,500,242 | 3/1950 | Denton | 200/35 X |
| 2,509,336 | 5/1950 | Darby | 211/35 |
| 2,620,072 | 12/1952 | Searcy | 211/35 |
| 2,682,955 | 7/1954 | Moore | 211/35 |
| 2,931,513 | 4/1960 | Cignoli | 211/35 |
| 3,172,537 | 3/1965 | Kraft | 211/35 |
| 3,776,643 | 12/1973 | Titoff | 206/8 X |
| 4,109,335 | 8/1978 | Randolph | 211/35 X |
| 4,460,094 | 7/1984 | Schoen | 211/35 |
| 4,693,380 | 9/1987 | Muth | 211/35 |
| 4,779,743 | 10/1988 | McKinnon | 211/35 |
| 4,867,407 | 9/1989 | Becker | 248/444.1 |
| 4,984,327 | 1/1991 | Braverman | 211/35 X |
| 5,645,178 | 7/1997 | Conley, Jr. | 211/89.01 X |
| 5,746,332 | 5/1998 | Kleinschmidt | 211/153 |
| 5,829,787 | 11/1998 | Newhouse, Jr. | 248/444.1 X |

*Primary Examiner*—Daniel P. Stodola
*Assistant Examiner*—Erica B. Harris
*Attorney, Agent, or Firm*—Factor and Shaftal

[57] ABSTRACT

A display device comprising at least one accepting member capable of accepting a product, and at least one view enhancing member associated with the at least one accepting member, at least a portion of the at least one view enhancing member comprising a reflective surface, so as to reflect at least a portion of a product accepted by the accepting member to, in turn, enhance the viewing of same.

15 Claims, 12 Drawing Sheets

203
206
210
208
204
205
200
210

220
210
212
212
210
200
208
206
202
218
218
216
204
205
210

202
210
212
212
210
206
208
204
205
210

216
214
200

FG 16A

PRODUCT DISPLAY SYSTEM

This application is a continuation-in-part of co-pending U.S. application Ser. No. 08/967,398 entitled "PRODUCT DISPLAY SYSTEM" filed Nov. 11, 1997, which application claimed the benefit of U.S. provisional application No. 60/030,654 entitled "PRODUCT DISPLAY SYSTEM" filed Nov. 12, 1996.

BACKGROUND OF THE INVENTION

1. Field of the Invention

This invention relates in general to a display device and, more particularly, to a product display device adapted to show or exhibit both the top and bottom surfaces of the product, for example, athletic shoes.

2. Background Art

In today's competitive economy, effective product displays have become more important in promoting and selling products. One particular area in which product displays have become critical is in the sale of athletic shoes. For several years logos, designs, and colors provided on the top of athletic shoes have been vital to effective marketing of the products. More recently, graphics, logos, and other designs which are incorporated into the bottom or sole of the shoe have also been critically important. The prior art displays do not provide a mechanism for effectively and simultaneously displaying the soles and the upper portions of shoes. The product display system according to the invention overcomes these problems, among others, without dramatically impacting the space required to display the shoe products.

SUMMARY OF THE INVENTION

The present invention is directed to a display device comprising: a) at least one accepting member capable of accepting a product; and b) at least one view enhancing member associated with the at least one accepting member, at least a portion of the at least one view enhancing member comprising a reflective surface, so as to reflect at least a portion of a product accepted by the accepting member to, in turn, enhance the viewing of same.

In a preferred embodiment of the invention, the accepting member comprises a substantially planar surface for accepting at least a portion of a product on an upper surface thereof. Alternatively, in another preferred embodiment of the invention, the accepting member comprises a substantially planar surface for accepting the entirety of a product on an upper surface thereof. In this embodiment the upper surface is preferably substantially horizontal.

In another preferred embodiment of the invention, at least a portion of the accepting member comprises at least one of a transparent and translucent surface.

In yet another preferred embodiment of the invention, at least a portion of the reflective region of the enhancing member is positioned below a lower surface of the accepting member.

In an additional embodiment of the invention, at least a portion of the reflective region of the enhancing member is angled at an acute angle relative to the upper surface of the accepting member. In this embodiment the enhancing member includes a proximal end and the accepting member includes a proximal end, the enhancing member and the accepting member being joined away from the proximal ends thereof.

In yet another embodiment of the invention at least one of the at least one accepting member and the at least one view enhancing member is secured to a mounting member by at least one of the group consisting of threaded fasteners, non-threaded fasteners, rivets, slot and tab mechanisms, slot and channel mechanisms, peg and aperture mechanisms, bracketing mechanisms, natural and synthetic adhesives, single and double sided sticky tape, and composite materials.

In a preferred embodiment of the invention, at least one of the at least one accepting member and the at least one view enhancing member is pivotally secured to a mounting member.

In another preferred embodiment of the invention, the display device further comprises at least one base. Additionally, the display device can include an accepting member having means for suspending the product. In this embodiment the suspending means includes at least one of a rod, shoe tree, string, chain, clamp, hook, and composite member.

In another preferred embodiment of the invention, the view enhancing member includes means for modifying the image of an accepted product. In this embodiment the modifying means includes at least one of an enlarging, a reducing, and a distorting reflective surface.

BRIEF DESCRIPTION OF THE DRAWINGS

The invention will now be described with reference to the drawings in which:

FIG. 16A and 16B are perspective views of display devices in accordance with the present invention associated with a wall or mounting structure;

DETAILED DESCRIPTION OF THE PREFERRED EMBODIMENTS

Figure 1:
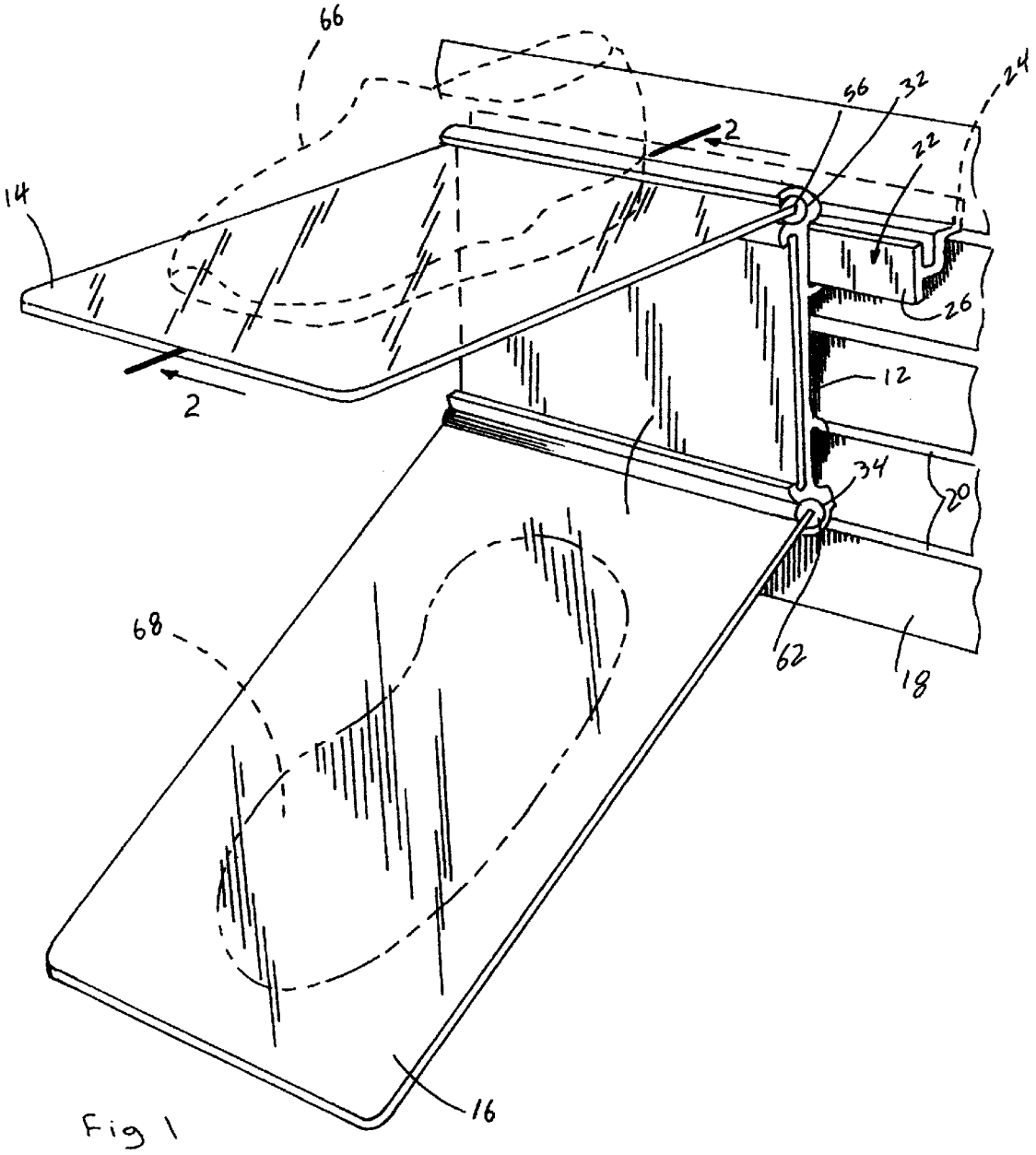
FIG. 1 is a perspective view of a first embodiment of a product display system according to the invention showing the display system mounted to a conventional wall structure.

While this invention is susceptible of embodiment in many different forms, there is shown in the drawings and will herein be described in detail specific embodiments with the understanding that the present disclosure is to be considered as an exemplification of the principles of the invention and is not intended to limit the invention to the embodiments illustrated.

Figure 2:
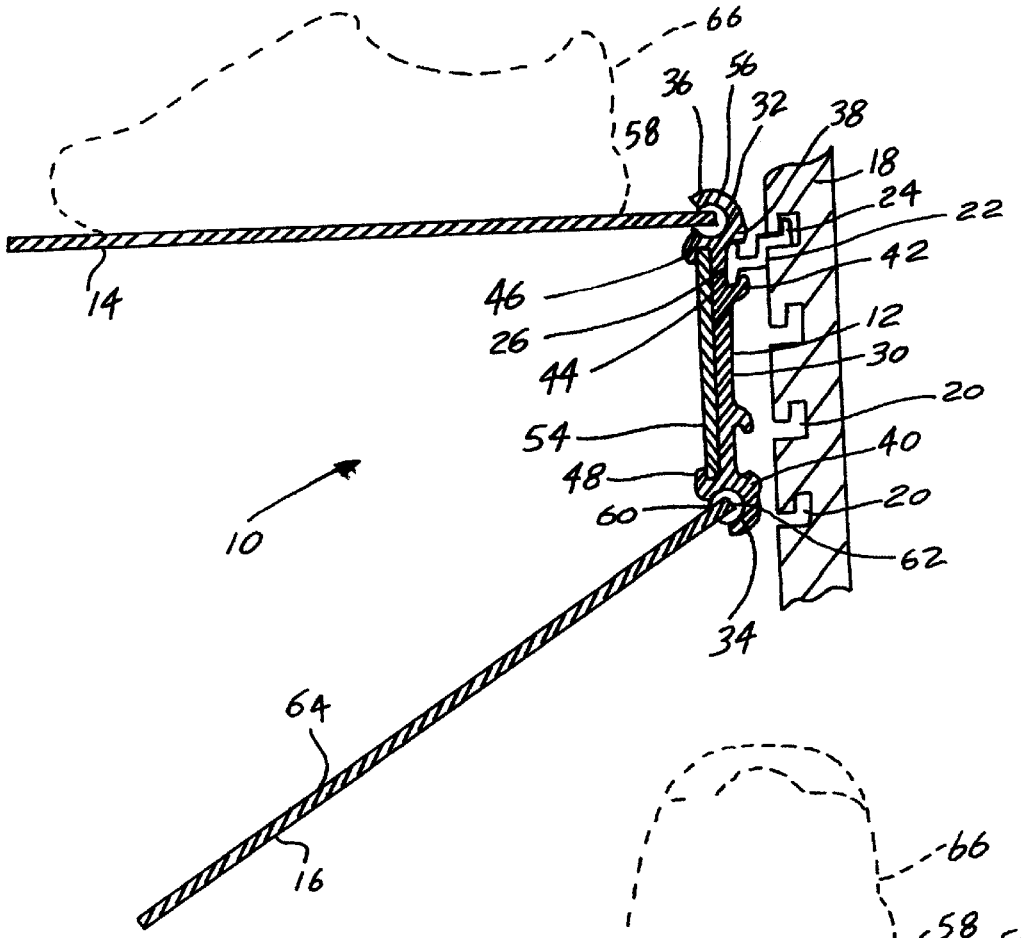
FIG. 2 is a cross-sectional view taken along lines 2—2 of FIG. 1.

Turning now to the drawings and to FIGS. 1 and 2 in particular, a first embodiment of a product display system 10 is shown as comprising a mounting member or backing plate 12, a support member 14 mounted to the backing plate 12, and a view enhancing member 16 also mounted to the backing plate 12. Preferably, the support member 14 is fabricated from a transparent material such as glass or plexiglass. The product display system 10 according to the invention is ideally suited for mounting to a conventional slotted wall structure 18 which includes multiple L-shaped slots 20 adapted to receive a mounting bracket 22. One end of the bracket is L-shaped 24, complimentary to the slot. The other end of the bracket is T-shaped 26 and as will be described further below, is adapted to be mounted to the backing plate member 12.

The backing plate 12 comprises a substantially planar plate 30 having a first channel 32 formed at the top of the plate 30 and a second channel 34 provided at the bottom of the plate 30. Each of the channels are defined by a substantially circular outer wall 36 which is integrally formed into the backing plate. Tapped holes are provided in the circular outer wall 36 and are adapted to receive set screws 38, 40 which will be described in greater detail below. The rear surface of the backing plate 30 further comprises at least one retention flange 42 which cooperates with the circular outer wall 36 of the channel 32 to define a groove 44 for slidably receiving the T-shaped end 26 of the mounting bracket 22. In practice, the plate 30 is slidably mounted to the mounting bracket 22 which is then mounted to the slotted wall structure 18 by inserting the L-shaped end 24 of mounting bracket 22 into one of the L-shaped slots 20. The cooperating mounting bracket 22 and slotted wall structure 18 are the preferred method for supporting the backing plate. However, the backing plate could be mounted to a supporting wall by any conventional means.

Figure 3:
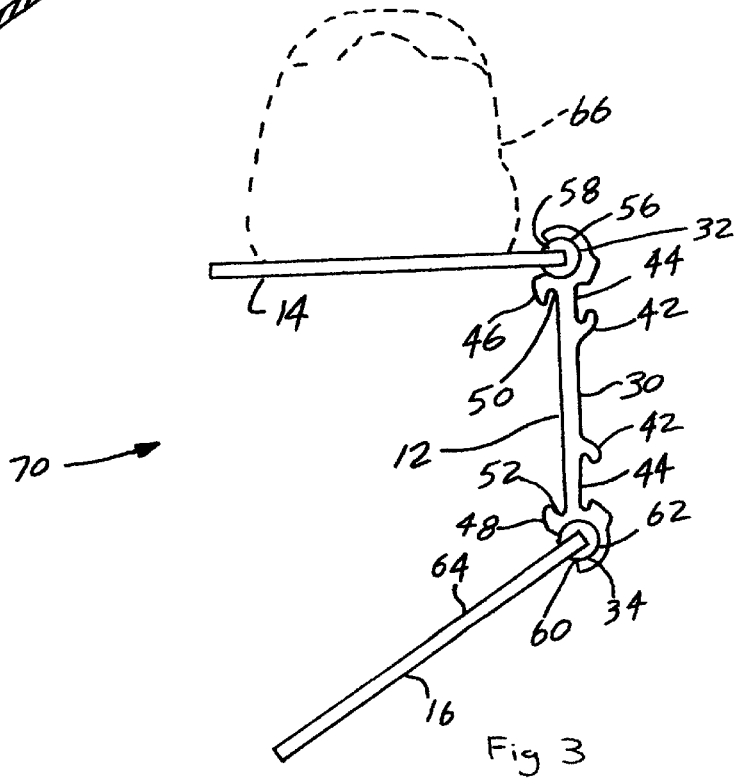
FIG. 3 is a side-elevational view of a second embodiment of a product display system according to the invention.

The front surface of the plate 30 includes a pair of opposed display sign flanges 46, 48 which, in cooperation with the circular outer wall 36 of the channels 32, 34 and front surface of the plate 30, define a pair of display sign grooves 50, 52. The grooves are adapted to slidably receive a display sign 54. The sign can take the form of graphics, a mirror surface, sales tag, product information, or the like. FIGS. 1 and 2 show the display sign 54 mounted in the opposed grooves 50, 52. However, as shown in FIG. 3, there is no need to include the display sign.

As shown in FIGS. 1 and 2, the support member 14 is substantially planar and has a boss 56 provided on one end thereof. Preferably, the boss 56 is complementary to the interior surface of the first channel 32. The boss 56, support member 14, and the opening 58 of the first channel 32 are dimensioned so that the boss 56 is slidably received in the channel 32 and the support plate extends through the opening 58 of the first channel, but the boss 56 is larger than the opening 58, thereby preventing removal of the support member and boss 56, except for sliding movement parallel to the axis of the first channel. In a preferred embodiment, the boss 56 and the first channel 32 are substantially circular in cross section so that the relative angle of the outwardly extending support member 14 relative to the backing plate 12 can be quickly and easily adjusted. The set screw 38 is adapted to frictionally engage the boss 56 and hold the boss and support member 14 in a desired angular orientation with respect to the backing plate 12. With the set screw 38 rotated such that it does not engage the boss 56, the support plate 14 can be rotated through a wide range of suitable orientations. Once the desired angular orientation of the support plate 14 with respect to the backing plate 12 and wall 18 has been reached, the set screw is tightened to frictionally engage the boss 56.

The view enhancing member 16 similarly has a boss 62 provided on one end thereof which is rotationally mounted in the second channel 34 and frictionally retained in a particular angular orientation through the set screw 40. Similar to the support member 14, the view enhancing member 16, boss 62, channel 34 and channel opening 60 are dimensioned to permit various angular orientations of the view enhancing member to the backing plate 12, wall, and support member 14.

The particular display application which the product display system 10 according to the invention is ideally suited for is displaying footwear, specifically, athletic shoes 66. Preferably, the support member 14 is formed from a transparent plastic material, and preferably, the view enhancing member 16 has a reflective surface 64 provided thereon. Therefore, as a shopper stands in front of the product display system 10, he can easily observe the top surface of the shoe 66 supported on the support member 14, and by looking at the reflective surface 64 of the view enhancing member 16, the shopper can easily observe the reflection of the shoe sole 68. In other words, the shopper can easily observe both the top and bottom surfaces of the product positioned on the support member 14 without removing the shoe 66 from the display. Simultaneous with this, additional signage or display materials can be positioned in the display sign grooves 50, 52. With the product display system according to the invention, the angular orientation of the support member 14 and view enhancing member 16 can be quickly and easily altered depending upon the position of the product display system 10 along the wall height and the anticipated position of shoppers. When the product display is positioned near the bottom of a wall 18, the angle between the plate 30 and the view enhancing member 16 approaches 90 degrees. For those product display systems positioned near the top of the wall 18, the relative angle between the view enhancing member 16 and the plate 30 is significantly greater than 90 degrees but does not exceed 180 degrees. Although the preferred embodiment shows the support member 14 positioned above the view enhancing member 16, in some circumstances, such as when the product is positioned very high on the support wall, it may be appropriate to reverse this orientation so that the view enhancing member 16 reflects down to the observer the top surface of the athletic shoe 66 rather than the bottom surface. In the orientation, the bottom surface would be clearly visible through the support member 14, assuming that the support member were transparent.

FIG. 3 shows a second embodiment of the product display system 70 according to the invention. In this embodiment, the length of the support member 14 and view enhancing member 16 has been reduced, but the width has been increased to accommodate the shoe 66 which has been rotated 90 degrees from the orientation as shown in FIG. 1. In this embodiment, the product display system 70 will necessitate additional wall space but similarly will not extend outwardly as far from the wall as required by the system shown in FIG. 1. In addition, the second embodiment of the product display system 70 does not include a display sign 54, as shown in the embodiment shown of FIG. 1. As noted above, the incorporation of a display sign 54 is optional.

Figure 4:
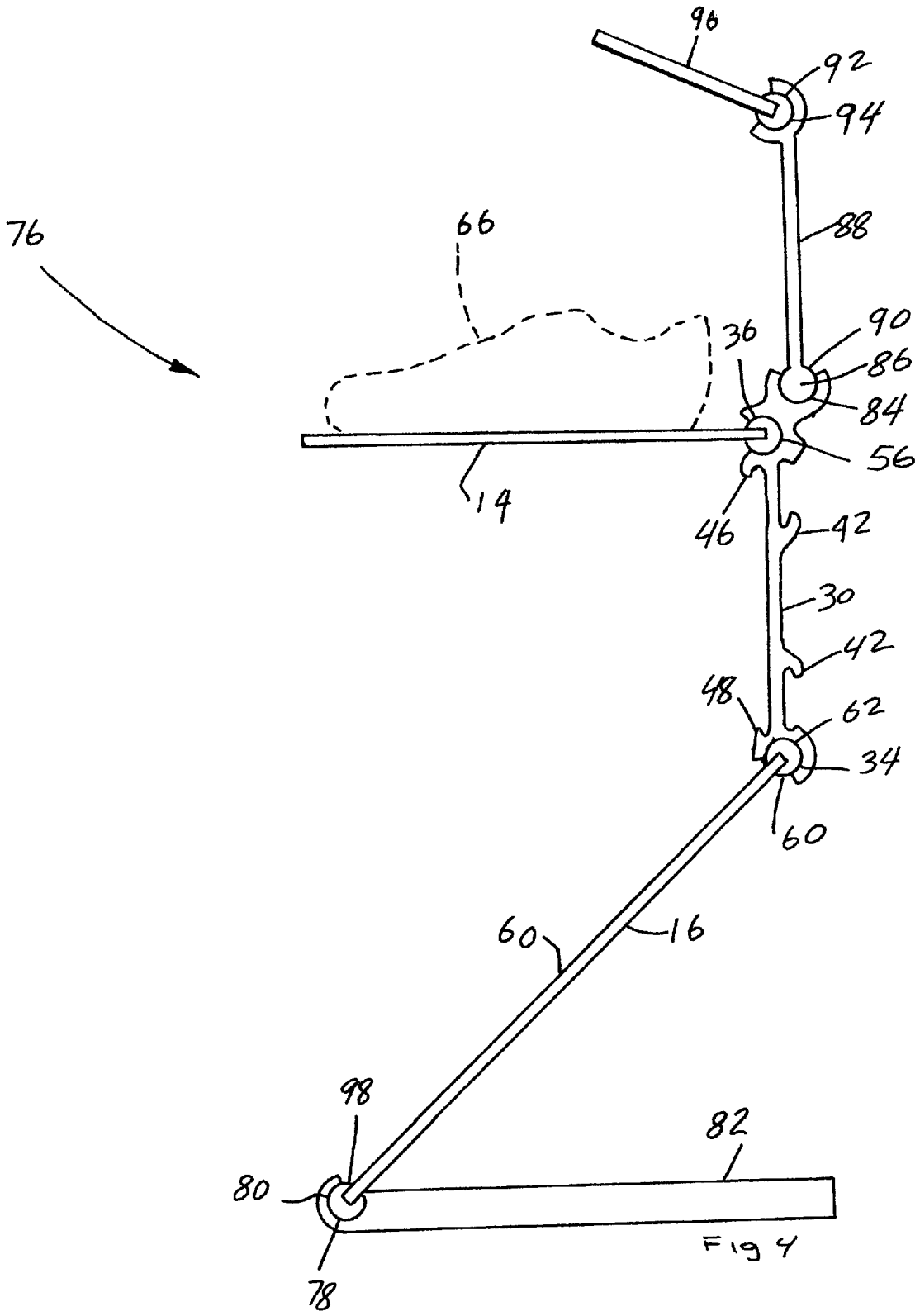
FIG. 4 is a side-elevational view of a third embodiment of a product display system according to the invention.

FIG. 4 shows a third embodiment of a product display system 76. As in the first embodiment, a product such as a shoe 66 is supported on the support member 14 which is, in turn, slidably mounted in the first channel 32 of the backing plate 12. Similarly, the boss 62 of the view enhancing member is slidably received in the second channel 34 of the plate 30. In the third embodiment, a second boss 78 is provided at the terminal end of the view enhancing member 16. The boss 78 is slidably received in a complementary channel 80 formed in a base 82. Similar to the earlier embodiments, the boss 78 is frictionally retained in the groove 80 by a set screw (not shown), and the angular orientation of the view enhancing member 16 with respect to the base 82 can be quickly and easily altered depending upon the size of the channel opening 98. The base 82 comprises a planar member which is adapted to rest upon the floor or other horizontal surface. Preferably, the base 82 is weighted to provide sufficient stability for the product display 76. Through the incorporation of the base 82, the product display 76 is freestanding and need not be mounted to any support wall. This provides flexibility regarding the positioning of the product display 76 within the store while retaining the benefits of being able to display the reflection of the bottom surface of the shoe 66 or other product mounted on the support member 14.

The third embodiment of the product display 76 can be further modified by providing means for a reflective display on the top of the product. Preferably, this is accomplished by integrally forming a third channel 84 into the backing plate 12. Preferably, the third channel 84 is circular in cross section and receives a complementary boss 86 provided on the end of a plate 88. As in the other embodiments, the boss 86 is frictionally retained in the third channel 84 by a set screw (not shown), and the opening 90 of the channel 84 is large enough so that the angular orientation of the plate with respect to the backing plate 12 can be altered. The upper end of the plate 88 has a fourth channel 92 integrally formed therein which is adapted to slidably receive a boss 94 provided on one end of a second view enhancing member 96. As in earlier embodiments, the boss 94 is retained in the channel 92 by a set screw, and the opening of the channel is dimensioned to permit angular adjustments of the second view enhancing member 96 with respect to the upper plate 88.

Incorporating the second view enhancing member 96 provides yet another way to easily, simultaneously display both the top and bottom surfaces of a product. Once again, the ability to alter the angles of the support member 14, first view enhancing member 16, backing plate 12, upper plate 88 base 86, and second view enhancing member 98 with respect to one another provides nearly unlimited applications and modifications of the product display system 76 according to the invention.

Figure 6:
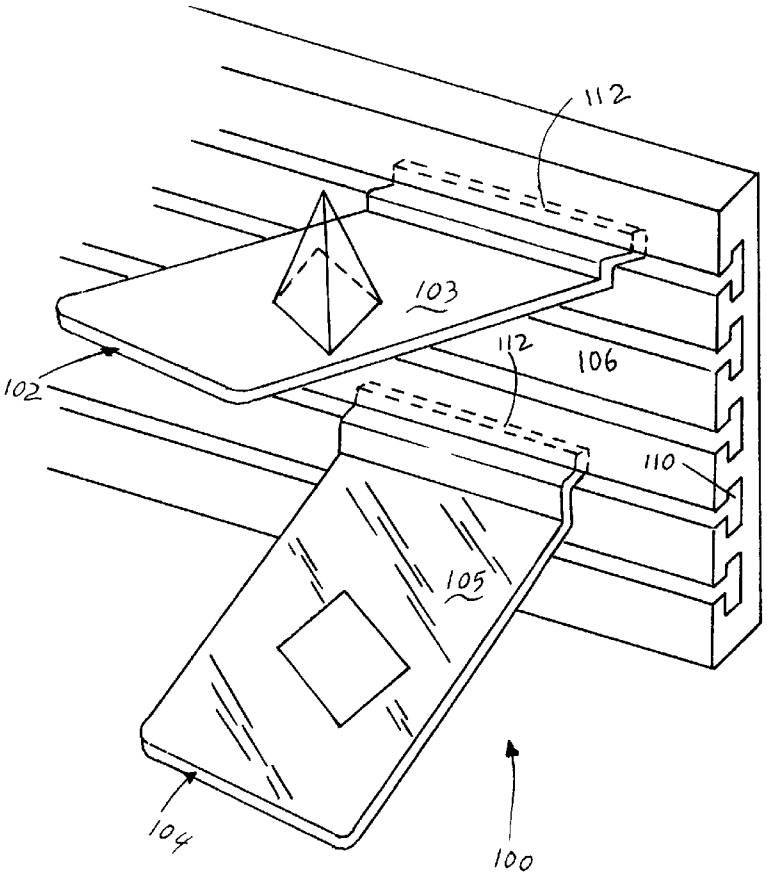
FIGS. 5 and 6 are perspective views of different configurations of a fourth embodiment of a display device in accordance with the present invention.
Figure 5:
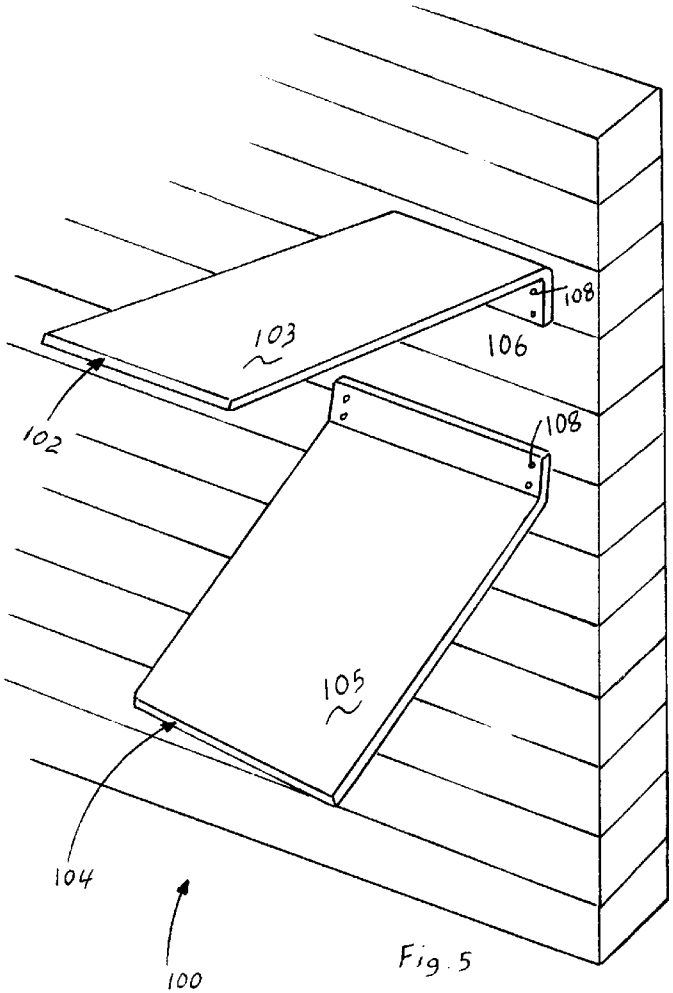

A fourth embodiment of a display device 100 is shown in FIG. 5 as generally comprising substantially planar accepting member 102 and substantially planar view enhancing member 104. Accepting member 102 includes a surface 103 which is adapted to accept a product thereon. View enhancing member 104 includes reflective surface 105 which is operatively positioned so that an observer of display device 100 can observe more than one surface of the product—preferably the bottom of the product. Accepting member 102 is preferably fabricated from a material such as glass, plexiglass, synthetic resins, or any type of composite material that is at least partially transparent or translucent, although such qualities are not necessary in all display devices. While accepting member 102 and view enhancing member 104 have been disclosed as substantially rectangular, it is also contemplated that such members can be configured with a peripheral geometry that substantially conforms to the product and/or products displayed. Of course, accepting member 102 and view enhancing member 104 can be configured so as to have any one of a number of peripheral geometries. Accepting member 102 and view enhancing member 104 are secured to mounting member 106 by fasteners 108. While fasteners 108 have been disclosed, for illustrative purposes only, as conventional screws or threaded fasteners, it is likewise contemplated that any one of a number of fasteners and/or fastening mechanisms are likewise contemplated such as, but by no means limited to, non-threaded fasteners, rivets, slot and tab mechanisms, peg and aperture mechanisms, bracketing mechanisms, natural and synthetic adhesives, single and double sided sticky tape, and any type of composite fastener known to those having ordinary skill in the art. Such a slot and channel mechanism is shown in FIG. 6, wherein mounting member 106 includes slots 110 and both accepting member 102 and view enhancing member 104 include L-shaped tabs 112 that mate with slots 110 and, in turn, removably secure accepting member 102 and view enhancing member 104 to mounting member 106.

Although accepting member 102 and view enhancing member 104 have been disclosed as being non-pivoting, it is likewise contemplated that either one or both of such members can be pivotal between various discrete and/or continuous angles. Such pivoting means may include those described herein relative to earlier embodiments and also include a conventional C-channel and mating boss configuration which has grooves or teeth—similar to that of a rack and pinion mechanism.

It will be understood that view enhancing member 104 includes a reflective surface 105 that reflects a substantially unmodified image of an accepted product. Of course, view enhancing member 104 may also include means for modifying the image of an accepted product. Such means may enlarge, reduce, or distort the accepted product.

Figures 7, 8A, 8B:
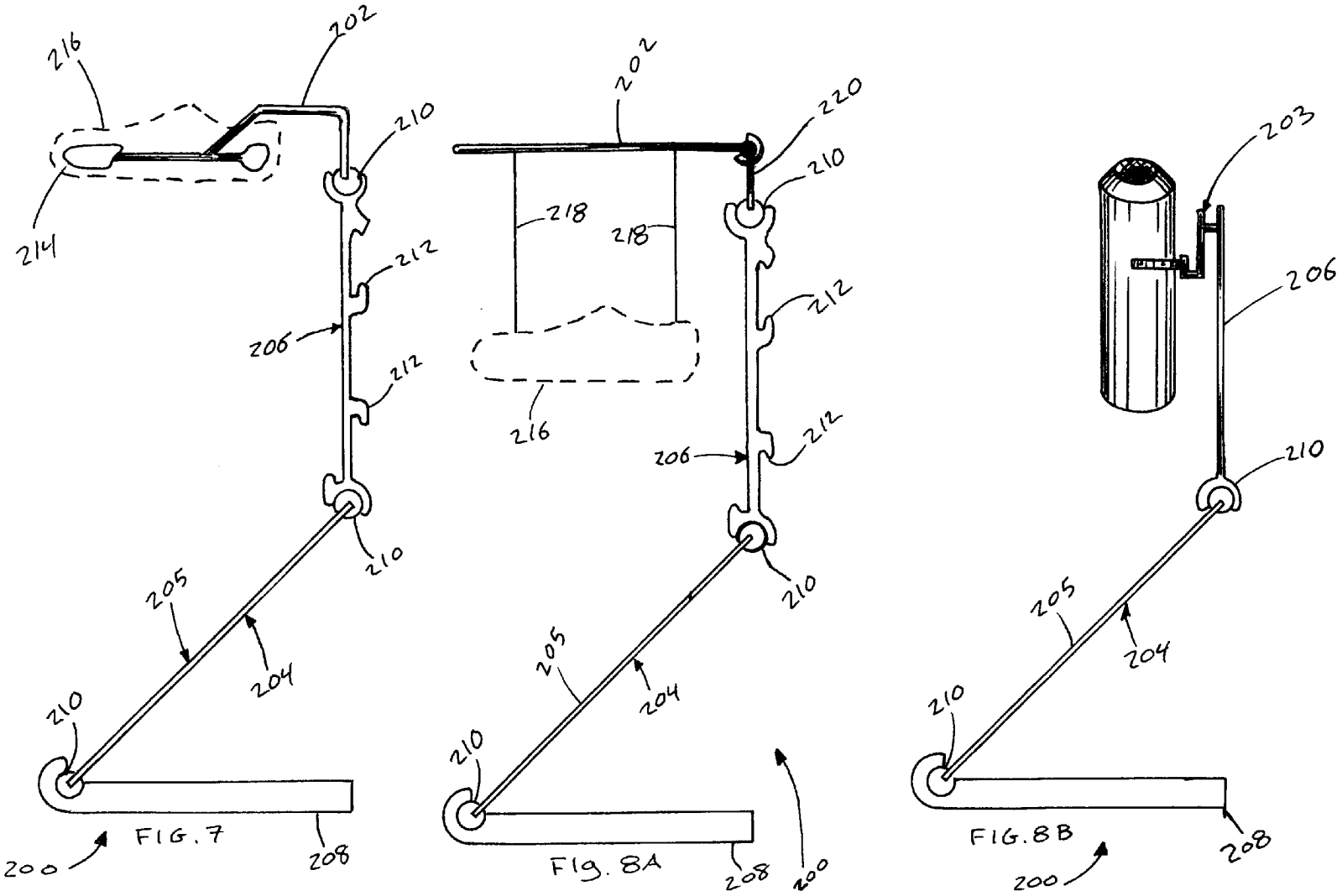
FIGS. 7, 8A, and 8B are side-elevational views of different configurations of a fifth embodiment of a display device in accordance with the present invention.

A fifth embodiment of a display device 200 is shown in FIG. 7 as generally comprising accepting member 202, view enhancing member 204, mounting member 206, and base 208. As will be understood, base 208 is optional inasmuch as mounting member 206 can be secured to a wall structure.

Each of the aforementioned components of display device 200 are secured to another component by C-channel/boss mating mechanisms 210. Of course, any one of a number of mating mechanisms known to those having ordinary skill in the art are likewise contemplated for use.

Accepting member 202 includes a mechanism for suspending the product. In particular, shoe tree 214, suspends shoe 216 a distance from view enhancing member 204. Of course, the configuration of the suspending mechanism directly depends upon the configuration of the product displayed. Therefore, the suspending mechanism can be configured into any one of a number of shapes. As shown in FIG. 8A the suspending mechanism may also comprise conventional string 218 attached to both shoe 216 and accepting member 202. When using such a configuration an extender member 220 may optionally be utilized in the display device. As further shown in FIG. 8B the suspending mechanism may also comprises conventional hook 203. While three specific suspending mechanisms have been shown, for illustrative purposes only, several other suspending mechanisms are likewise contemplated for use, including chains and composite members.

As shown in FIG. 7, mounting member 206 includes flanges 212 for mounting signage to the display device or for mounting member 206 and, in turn, the entire display device to a wall structure. Of course, when mounted to a wall structure base 208 of the display device may be removed.

View enhancing member 204 includes a reflective surface 205 which is operatively positioned so that an observer of the product display can observe more than one surface of an associated product.

Figure 9A:
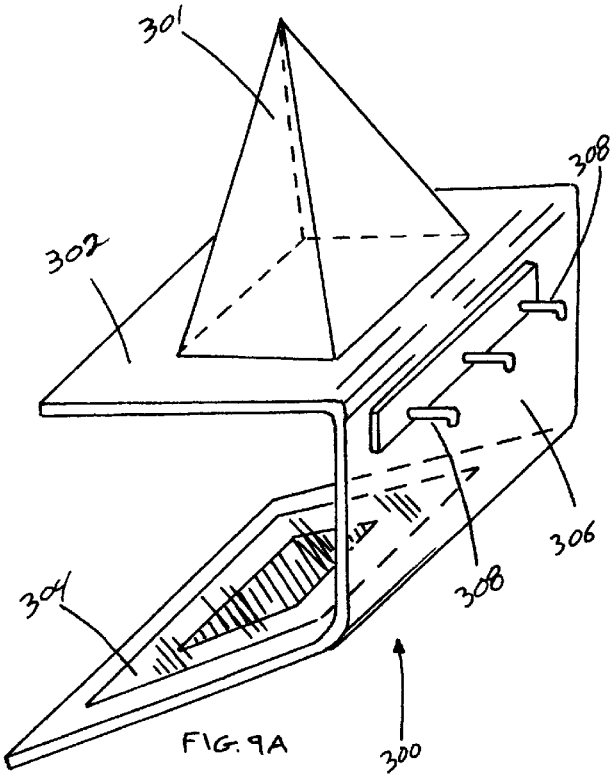
FIGS. 9A and 9B are perspective views of different configurations of a sixth embodiment of a display device in accordance with the present invention.

A sixth embodiment of a display device 300 is shown in FIG. 9A as generally comprising accepting member 302 adapted to support product 301, view enhancing member 304 operatively positioned so that an observer of the product display can observe more than one surface of product 301, and mounting member 306. Mounting member 306 further includes L-shaped pegs 308 which can be removably inserted into a board with apertures and, in turn, secured thereto. Such a securing mechanism is commonly referred to as a peg and aperture mechanism. While a peg and aperture mechanism has been disclosed, for illustrative purposes only, any one of a number of securing mechanisms known to those having ordinary skill in the art are likewise contemplated for use including, but by no means limited to, threaded fasteners, non-threaded fasteners, rivets, slot and tab mechanisms, slot and channel mechanisms, bracketing mechanisms, natural and synthetic adhesives, single and double sided sticky tape, and composite materials known to those having ordinary skill in the art.

Accepting member 302 is preferably fabricated from transparent or translucent materials such as glass, plexiglass, synthetic resins, or composite materials. While accepting member 302 has been disclosed as being substantially rectangular and planar, it is likewise contemplated that accepting member 302, as well as view enhancing member 304, can conform to the peripheral geometry of the supported product.

Figure 9B:
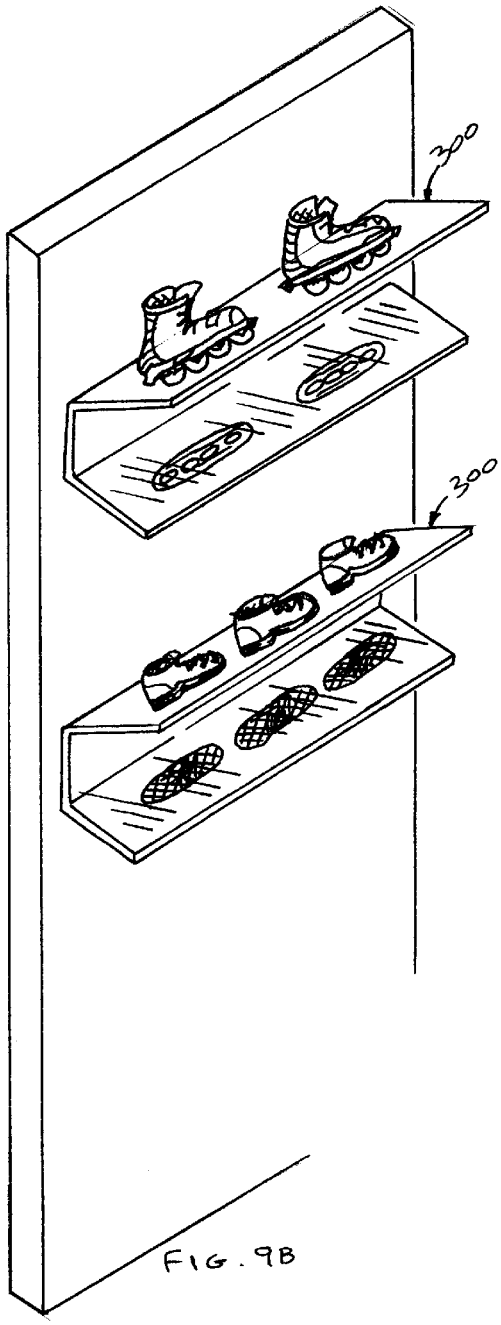
Figure 11:
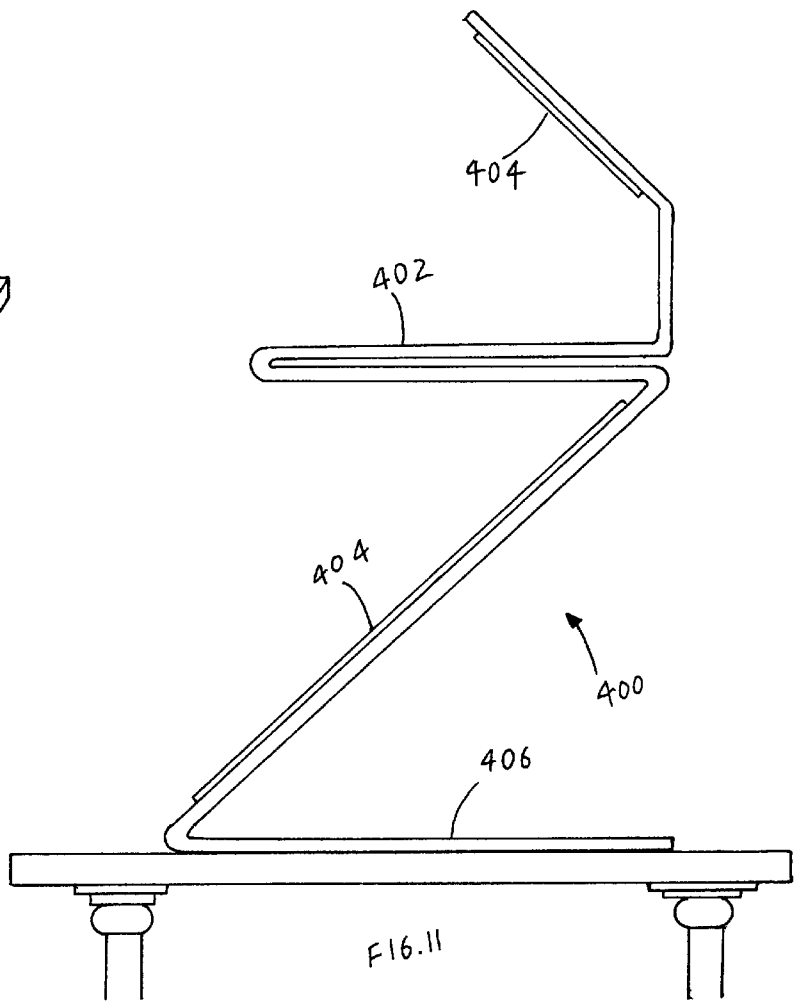
FIG. 11 is a side-elevational view of a second configuration of the seventh embodiment of a display device in accordance with the present invention.
Figure 10:
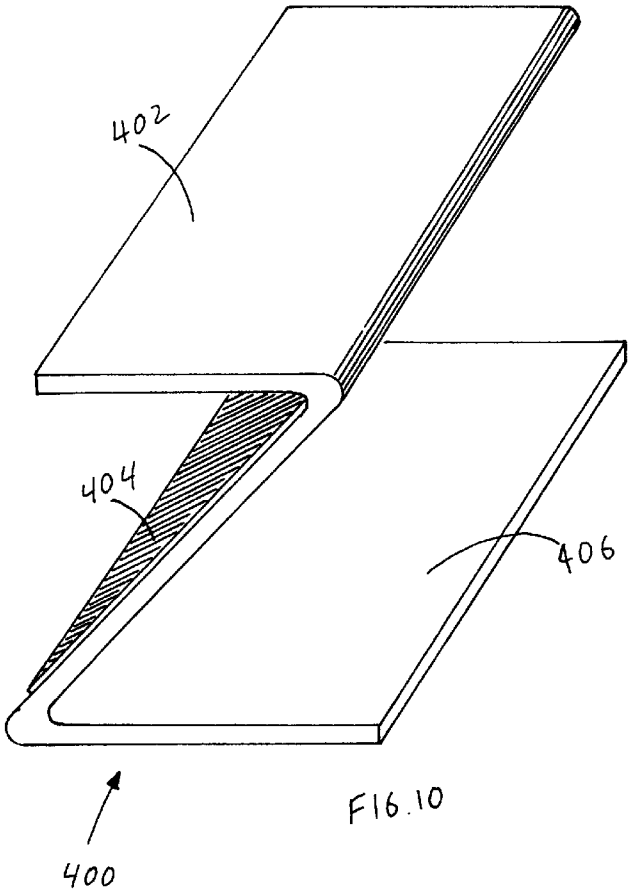
FIG. 10 is a perspective views of a different configuration of a seventh embodiment of a display device in accordance with the present invention.

As shown in FIG. 9A display device 300 is fabricated from a unitary piece of material. Of course, if desired, product display 300 can be made from a plurality of pieces so that accepting member 302 and view enhancing member 304 are pivotable. It will be understood, of course, that a plurality of display devises 300 can be attached to a wall structure, as shown in FIG. 9B. A seventh embodiment of a display device 400 is shown in FIG. 10 as generally comprising accepting member 402 adapted to support a product (not shown), view enhancing member 404 positioned so that an observer of the product display can observe more than one surface of the product, and base 406 suitable for engaging any substantially horizontal surface. Preferably accepting member 402 is fabricated from transparent or translucent materials, such as glass, plexiglass, synthetic resins, or any other composite material known to those having ordinary skill in the art. While accepting member 402 has been shown as generally rectangular, it is likewise contemplated that accepting member 402, view enhancing member 404, and base 406 can conform to the peripheral geometry of the supported product. Like other embodiments herein disclosed, display device 400 can be formed from a unitary piece of material, or a plurality of pieces so that its surfaces are pivotable. As shown in FIG. 11, display 400 can be configured with multiple view enhancing members 404 so that several sides of the product can be simultaneously displayed.

Figures 12A, 12B, 13:
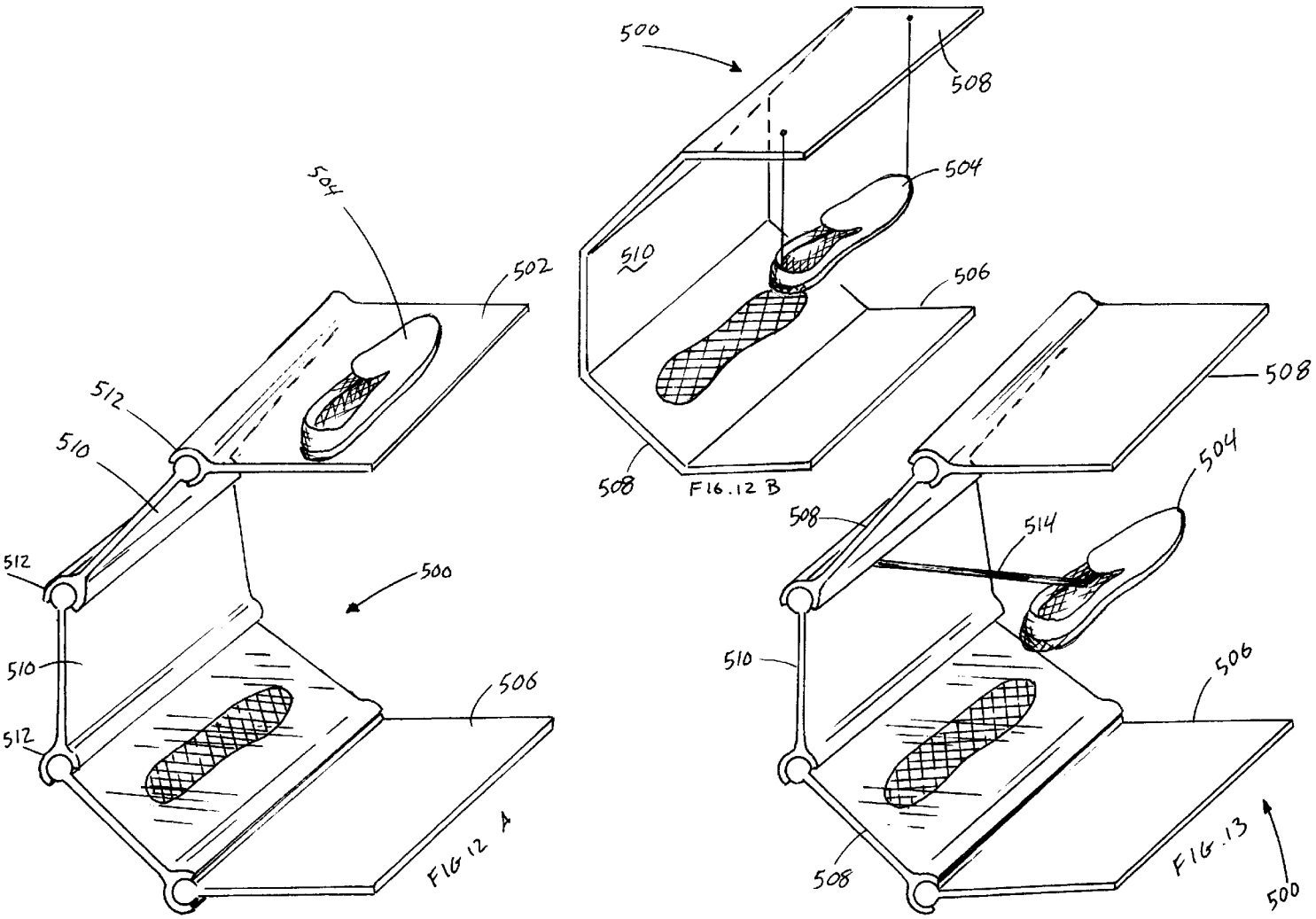
FIGS. 12A, 12B and 13 are perspective views of different configurations of an eight embodiment of a display device in accordance with the present invention.

An eighth embodiment of a display device 500 is shown in FIG. 12A as generally comprising accepting member 502 adapted to accept product 504, base member 506 and view enhancing members 508 positioned so that an observer of the display system can observe more than one surface of the product, and mounting members 510.

Each of the aforementioned members of display device 500 are pivotally secured to another member by C-channel/boss mating mechanisms 512. Of course any one of a number of mating mechanisms known to those having ordinary skill in the art are likewise contemplated for use. It is also contemplated that such a display devise can be manufactured from a unitary piece of material.

Display device 500 can be mounted to a wall structure (not shown) by securing a mounting member 510 to the wall structure using any one of a number of conventional securing mechanisms. Additionally, display device 500 can also be placed on a substantially horizontal surface—such as a floor, counter top, or built in wall system. Preferably accepting member 502 is fabricated from substantially transparent or translucent materials.

As shown in FIG. 13, display device 500 can also be configured with rod 514 which can be used to accept/suspend a product 504 within the display. Of course, other suspending means are likewise contemplated for use, such as, but by no means limited to, line (See. FIG. 12B), string, chains, shoe trees, clamps, hooks, or any other suspending mechanism known to those having ordinary skill in the art.

Figure 14:
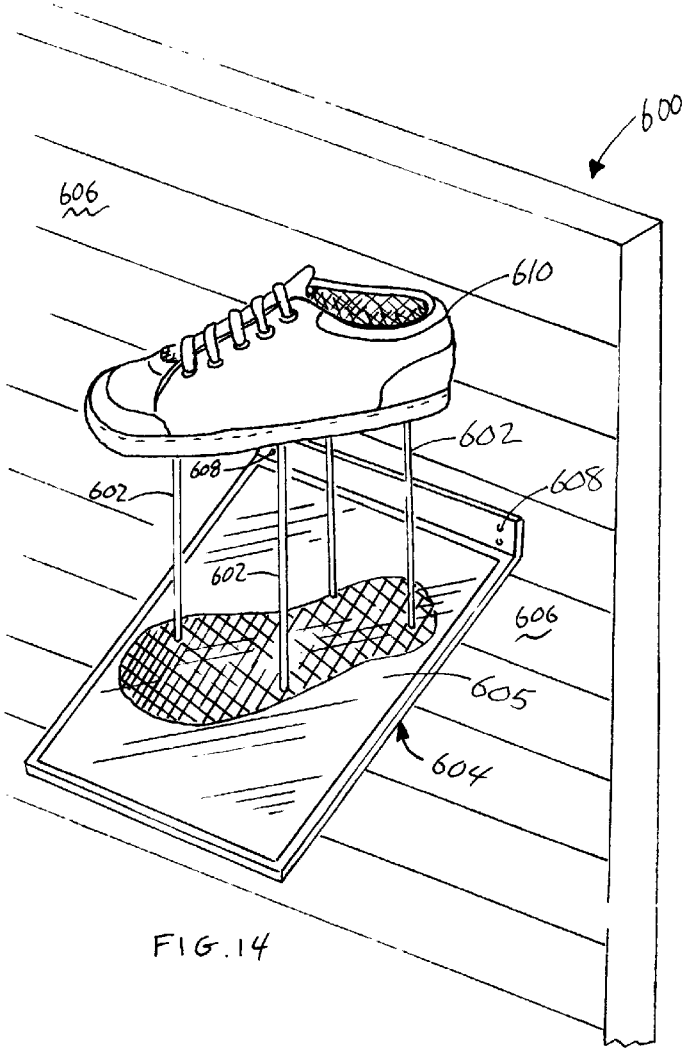
FIG. 14 is a perspective view of a ninth embodiment of a display device in accordance with the present invention.

A ninth embodiment of a display device 600 is shown in FIG. 14 as generally comprising suspending/accepting member 602 and substantially planar view enhancing member 604. Suspending/accepting member 602 is adapted to accept product 610 thereon. View enhancing member 604 includes reflective surface 605 which is operatively positioned so that an observer of display device 600 can observe more than one surface of the product—preferably the bottom of the product. View enhancing member 604 is preferably secured to mounting member 606 by fasteners 608.

Figure 15:
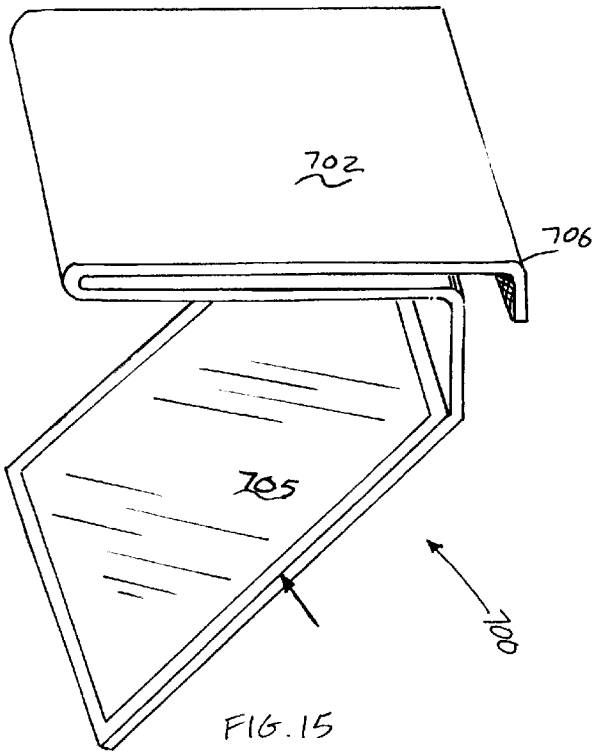
FIG. 15 is a perspective view of a tenth embodiment of a display device in accordance with the present invention.

A tenth embodiment of a display device 700 is shown in FIG. 15 as generally comprising accepting member 702 and substantially planar view enhancing member 704. Accepting member 702 is adapted to accept a product thereon, and includes L-shaped bracket 706 to serve as a hooking mechanism to secure display devise 700 to, for example, a wall, door, or counter top. View enhancing member 704 includes reflective surface 705 which is operatively positioned so that an observer of display device 700 can observe more than one surface of the product.

Figure 16B:
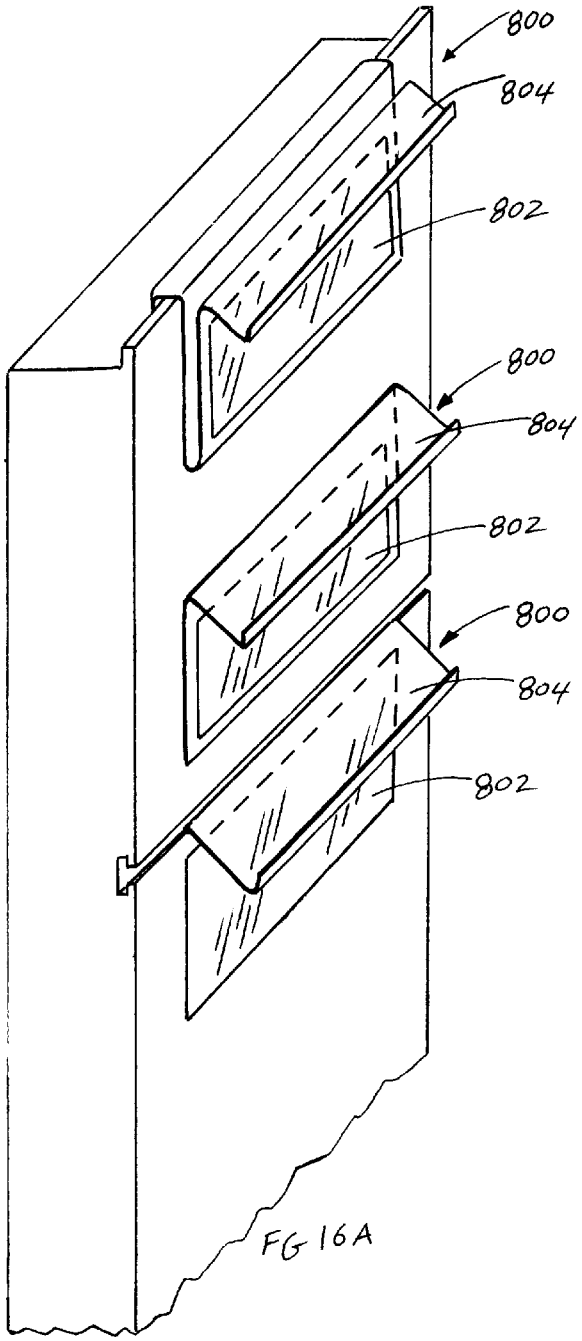
Figure 16B:
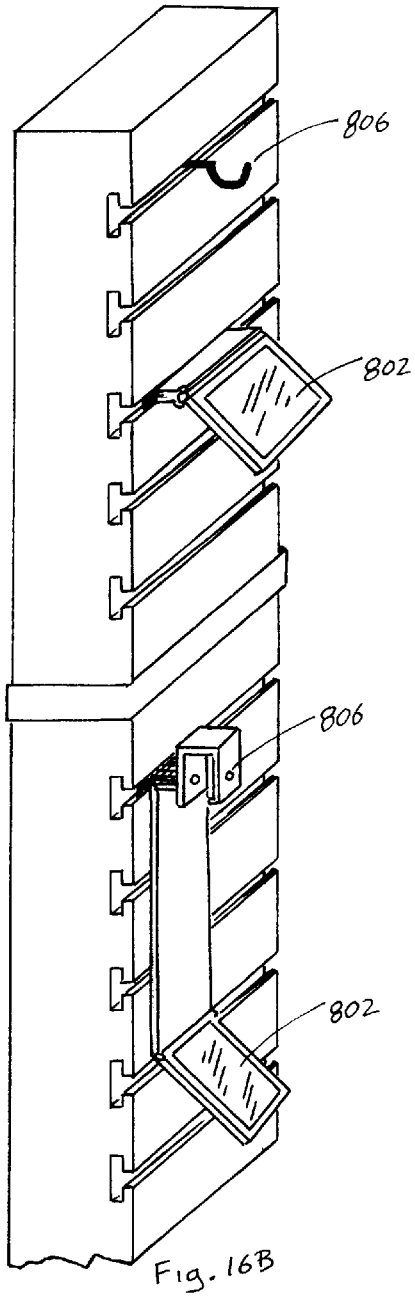

As shown in FIGS. 16A and 16B several display devises are likewise contemplated, including display devices 800 having substantially vertical view enhancing members 802 and angled accepting members 804. Moreover, product display devise 806 is shown in FIG. 16 as including an accepting/suspending member.

Figure 17B:
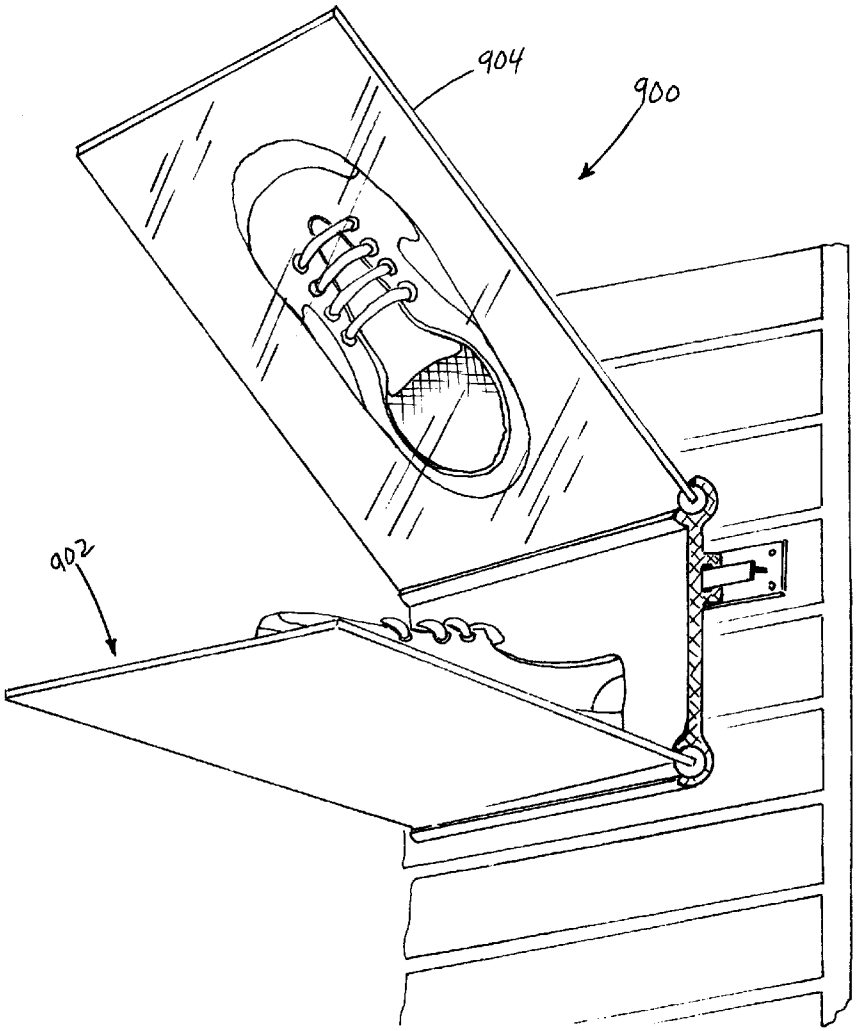
FIGS. 17A, 17B, and 17C are views of an eleventh embodiment of display devices in accordance with the present invention associated with a wall or mounting structure.
Figure 17A:
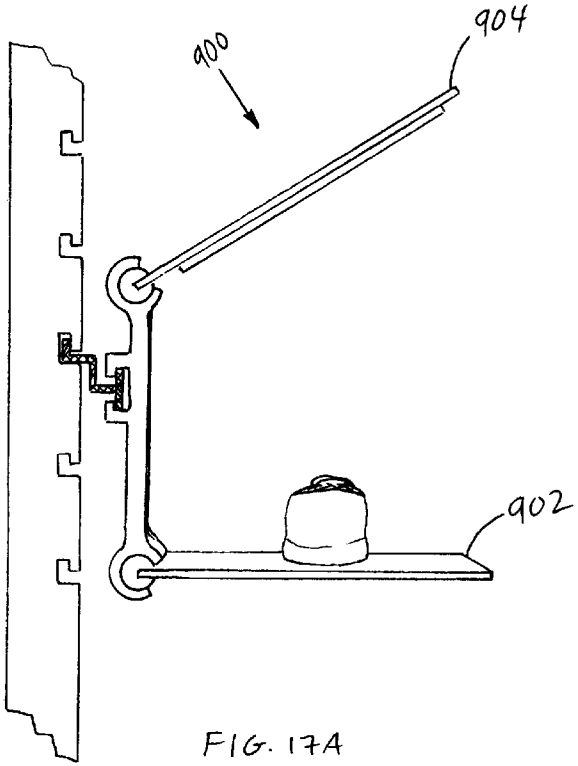
Figure 17C:
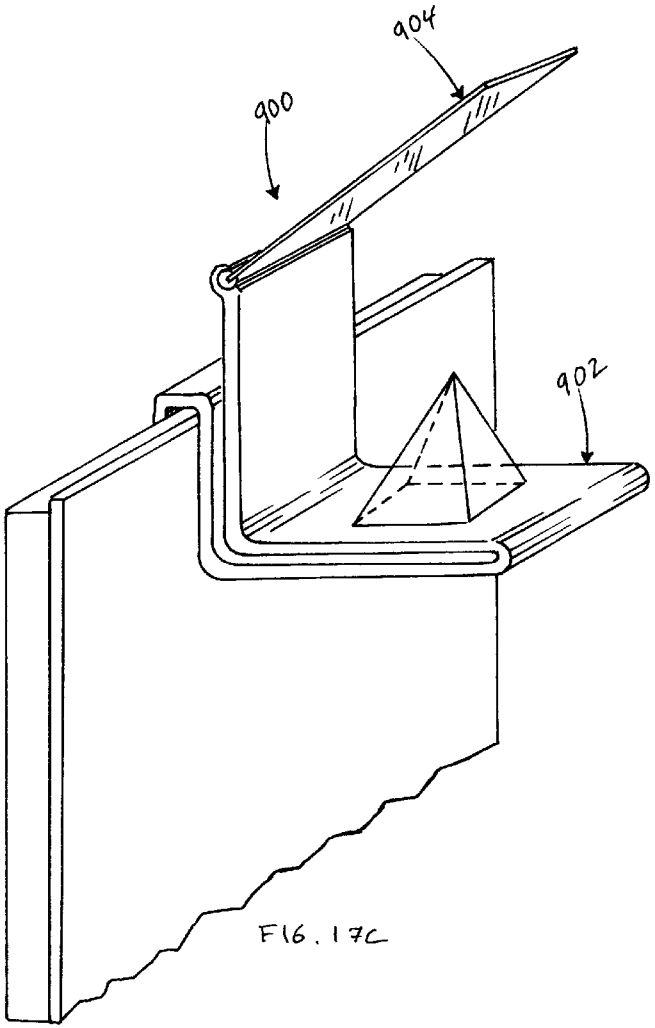

An eleventh embodiment of a display device 900 is shown in FIGS. 17A, 17B, and 17C, as generally comprising accepting member 902 and view enhancing member 904. In particular, view enhancing member 904 is preferably positioned above accepting member 902. Of course, display device 900 can be secured to a wall structure by any one of a number of mechanisms referenced herein.

Figure 18:
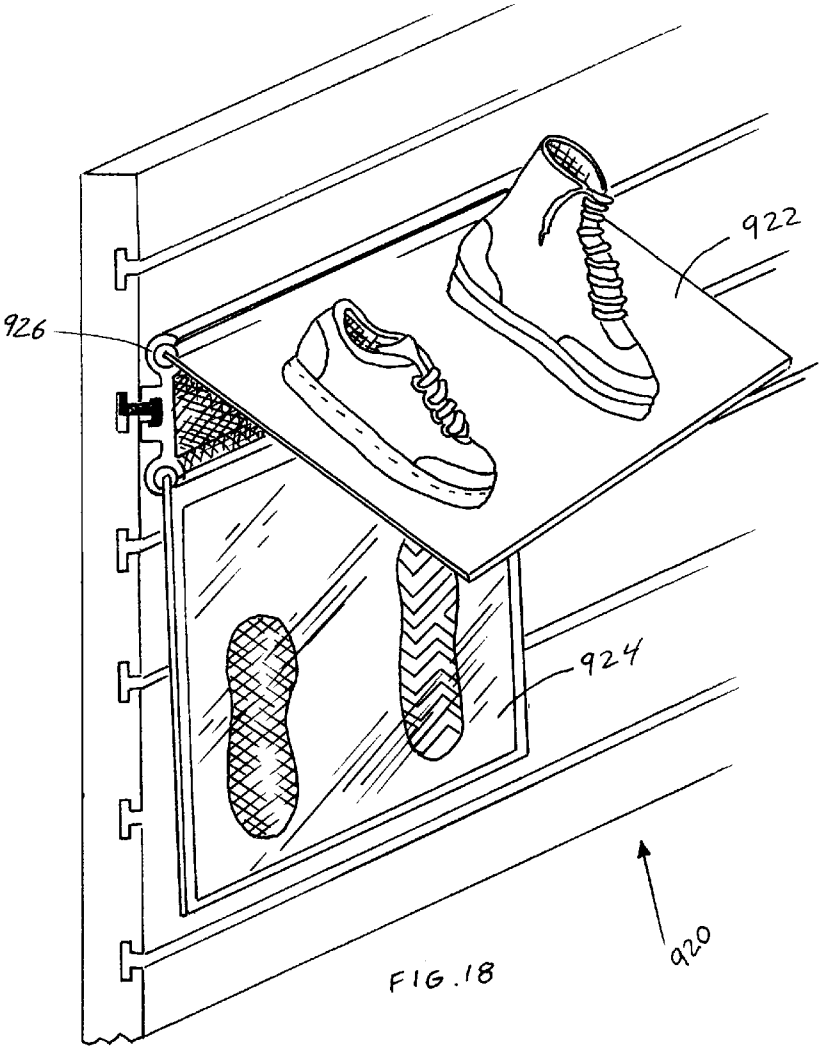
FIG. 18 is a perspective view of a twelfth embodiment of a display device in accordance with the present invention.

A twelfth embodiment of a display device 920 is shown in FIG. 18 as generally comprising accepting member 922 and view enhancing member 924. Both members 922 and 924 include a pivoting/locking mechanism 926.

A person skilled in the art will appreciate that the present invention extends to a wide variety of reflective display devises that can be adapted for use with virtually any product in which observation by the consumer of more than one surface of the product is desired.

The foregoing description and drawings merely explain and illustrate the invention and the invention is not limited thereto except insofar as the appended claims are so limited, as those skilled in the art who have the disclosure before them will be able to make modifications and variations therein without departing from the scope or spirit of the invention.

What is claimed is:

1. A product display system comprising:

a mounting member;

a substantially transparent, substantially planar product support member having a support surface located on a first side thereof adapted to receive and support a product thereon, the product support member being connected to the mounting member in a substantially horizontal orientation; and a reflective member having a reflective surface, the reflective member being connected to the mounting member so as to permit an observer of the product display system to view the surface of the product received on the support surface.

2. The product display system according to claim 1, further comprising a reflective member having a reflective surface positioned above the product support member.

3. The product display system according to claim 1, wherein at least a portion of the reflective surface of the reflective member is positioned below the support surface of the product support member.

4. The product display system according to claim 1, wherein at least a portion of the reflective surface of the reflective member is angled at an acute angle relative to the support surface of the product support member.

5. The product display system according to claim 1, wherein at least one of the product support member and the reflective member is secured to the mounting member by at least one fastening means.

6. The product display system according to claim 1, wherein at least one of the product support member and the reflective member is pivotally secured to the mounting member.

7. The product display system according to claim 1, further comprising at least one base.

8. A product display system comprising:

a mounting member;

means for suspending a product attached to the mounting member, wherein the product includes a bottom surface; and a reflective member having a reflective surface, the reflective member being attached to the mounting member so as to permit an observer of the product display system to view at least a portion of the bottom surface of the product while in its attached suspended orientation.

9. The product display system according to claim 8, further comprising at least one base.

10. The product display system according to claim 8, further comprising a reflective member having a reflective surface positioned above the means for suspending the product.

11. The product display system according to claim 8, wherein the suspending means includes one of a rod, shoe tree, string, chain, clamp, and hook.

12. The product display system according to claim 8, wherein the reflective member includes means for modifying the image of the suspended product.

13. The product display system according to claim 12, wherein the modifying means includes one of an enlarging, a reducing, and a distorting reflective surface.

14. A product display system comprising:

a substantially transparent, substantially planar product support member having a support surface located on a first side thereof adapted to receive and support a product thereon;

a reflective member having a reflective surface, to permit an observer of the product display system to view the surface of the product received on the support surface; and a base, wherein the product support member, the reflective member, and the base are respectively arranged with one another so as to form a substantially z-shaped cross section.

15. A product display system comprising:

a mounting member;

a product support member having at least one substantially vertical column adapted to receive and support a product thereon, the product support member being secured to a reflective member; and a reflective member having a reflective surface, to permit an observer of the product display system to view a surface of the product received on the support member, wherein reflective member is secured to the mounting member.

* * * * *